US005535655A

United States Patent [19]

Kammann

[11] Patent Number: 5,535,655

[45] Date of Patent: Jul. 16, 1996

[54] PUNCHING APPARATUS FOR WEB MATERIAL

[75] Inventor: Wilfried Kammann, Bünde, Germany

[73] Assignee: Kammann Spezialmaschinen Und Steuerungstechnik GmbH, Bunde, Germany

[21] Appl. No.: 332,902

[22] Filed: Nov. 1, 1994

[30] Foreign Application Priority Data

Nov. 8, 1993 [DE] Germany ..... 43 37 902.8

[51] Int. Cl.[6] ..... B26D 7/01

[52] U.S. Cl. ..... 83/559; 83/699.31

[58] Field of Search ..... 83/559, 560, 699.31, 83/699.41, 699.51, 699.61; 269/73, 72, 71, 60

[56] References Cited

U.S. PATENT DOCUMENTS

| | | | |
|---|---|---|---|
| 2,767,789 | 10/1956 | Budlong et al. | 83/559 |
| 3,006,245 | 10/1961 | Bycer et al. | 269/73 |
| 3,077,134 | 2/1963 | Ronick | 83/559 |
| 3,829,978 | 8/1974 | Basin et al. | 33/174 TA |
| 3,973,458 | 8/1976 | Reich et al. | 269/73 |
| 3,994,191 | 11/1976 | Pozsgay | 83/559 |
| 4,610,442 | 9/1986 | Oku et al. | 269/73 |
| 4,696,211 | 9/1987 | Bitzel | 83/559 |
| 4,703,678 | 11/1987 | Kiuchi | 83/559 |
| 4,770,531 | 9/1988 | Tanaka et al. | 356/358 |
| 4,854,532 | 8/1989 | Trovato | 248/178 |
| 4,964,326 | 10/1990 | Steinhoff | 83/559 |

FOREIGN PATENT DOCUMENTS

| | | | |
|---|---|---|---|
| 0167018 | 6/1989 | European Pat. Off. . | |
| 3513896 | 10/1986 | Germany | 269/73 |

*Primary Examiner*—Rinaldi I. Rada
*Assistant Examiner*—Charles Goodman
*Attorney, Agent, or Firm*—Howson And Howson

[57] ABSTRACT

In a punching apparatus for cutting portions out of a web of material, the punching tool assembly has a movable top punching tool and a bottom punching tool carried by a plate arrangement which includes a base, a first plate supported on the base and a second plate which is supported on the first plate and which carries the bottom tool. One of the plates is reciprocal transversely to the web of material while the other is pivotable about a substantially vertical axis. Movements of the plates relative to each other and relative to the base permit the punching tool assembly to be aligned with the portion to be punched out of the material web, prior to the punching operation. To reduce friction between the base and the relatively movable plates the apparatus has friction-reducing means which are reciprocal between an inoperative position in which the base and the plates are in contact with each other and an operative position in which the friction-reducing means provide for rolling friction between the relatively movable components. The friction-reducing means may be in the form of ball rolling units actuable between their inoperative and operative positions by piston actuators.

15 Claims, 6 Drawing Sheets

18
20
16
104
55
41
43
106
54
39
49
108
33
30
54
54
55
55

PUNCHING APPARATUS FOR WEB MATERIAL

FIELD OF THE INVENTION

The invention concerns a punching or stamping apparatus for use on web material, for example for punching or stamping the web material to sever defined portions therefrom. The web material may have markings which are associated with a respective defined region on the web material.

For the sake of simplicity herein the apparatus is referred to as a punching apparatus.

BACKGROUND OF THE INVENTION

A punching apparatus for web material, as is to be found in EP 0 167 018, has a punching tool which, if necessary, prior to each punching operation is aligned with the respective region which is to be punched out of the web material, that region being provided for example with printing thereon. The design configuration of that apparatus is such that the punching tool is arranged on a stationary base, with the interposition of a plate which is displaceable transversely relative to the longitudinal direction of the web material and also pivotable. The punching tool in that apparatus comprises two tool portions, constituting an upper tool portion and a lower tool portion. The upper tool portion is suitably carried by the lower tool portion, for which purpose the latter is provided with columns on which the upper tool portion is guided. Disposed around the columns are compression springs which hold the upper tool portion at a spacing from the lower tool portion. Arranged above the upper tool portion is a piston-cylinder unit which, for the purposes of effecting the punching operation, displaces the upper tool portion towards the lower tool portion, against the force of the compression springs. After the punching operation has been carried out the piston of the piston-cylinder unit is moved back upwardly into its starting position, in which case the upper tool portion is also moved back upwardly into its starting position in which it is at a spacing from the lower tool portion.

As the punching tool assembly consisting of the upper and lower tool portions is relatively heavy and may be for example more than 100 kg in weight, particular precautions are usually required to displace and pivot the transversely displaceable and pivotable plate which bears the weight of the punching tool assembly, with the aim of reducing the frictional forces between the transversely displaceable and pivotable plate and the stationary plate on which it is carried, so as to permit precise adjustment and setting of the movable plate in order to achieve satisfactory accuracy in the punching operation on the web material. In addition the forces required for adjusting the movable plate should not exceed a certain level, having regard to the power of the control motors required for that purpose.

In the punching apparatus in above-mentioned EP 0 167 018, to achieve the above aim the upper movable plate which thus performs both a transverse movement and also a pivotal movement is provided with means which permit the formation of an air cushion between the upper movable plate and the lower stationary plate, for adjustment of the punching tool assembly. The air cushion slightly lifts the upper plate which carries the punching tool assembly, from the lower stationary plate, so that the adjusting movements of the upper plate, which then take place, involve a markedly reduced amount of friction between the upper movable plate and the lower stationary plate which supports the upper plate. That arrangement however suffers inter alia from the disadvantage that the air cushion which thus supports the upper plate with the punching tool assembly in the adjustment procedure cannot provide any guarantee that the upper plate is always disposed parallel to the stationary plate therebeneath. A departure from a condition of parallelism between the two plates can occur for example by the upper plate involving an irregular distribution of weight over its area, so that the unequal weight loading causes the upper plate to tilt slightly relative to the lower plate. That departure from a parallel condition as between the upper and lower plates also affects the punching tool assembly which is carried by the upper plate, and can result in the final position of the upper plate with punching tool assembly carried thereon not precisely corresponding to the desired or reference position after the upper plate is lowered on to the lower plate again, due to elimination of the air cushion therebetween. The upper and lower plates would then no longer be accurately positioned relative to each other. Although the deviations which may occur in such a situation may admittedly be very slight, it is to be borne in mind that the requirements in terms of the level of accuracy with which the punching tool assembly is to be aligned with respect to the region to be punched out of the web material may be of an order of magnitude of less than 10 μm. A further difficulty with that punching apparatus is that the stationary plate must be relieved of the load of the weight of the entire punching tool assembly as the lower tool portion also supports the upper tool portion, by way of the columns and compression springs.

SUMMARY OF THE INVENTION

An object of the present invention is to provide a punching apparatus for web material, having a punching tool assembly adapted for movement relative to the web material for adjustment in relation thereto, which is of a simplified structure, in order thereby to permit highly accurate setting of the punching tool assembly under at least virtually all conditions which occur in practice.

Another object of the present invention is to provide a punching apparatus having a punching tool assembly which is movable for adjustment thereof relative to the web material to be punched, which permits easier adjusting movement of the punching tool assembly by virtue of easily operable means.

Still another object of the present invention is to provide a punching apparatus for web material having a punching tool assembly which comprises a bottom tool and a top tool and which is movable for accurate adjustment thereof relative to the web of material, wherein essentially only the weight of the bottom tool is operative, with only a reduced effect, during the operation of adjusting the punching tool assembly.

In accordance with the principles of the present invention the foregoing and other objects are attained by a punching apparatus comprising a punching tool assembly having a bottom tool and a top tool which is relatively movable with respect to the bottom tool and which is so connected to the bottom tool that it follows all movements thereof, for example transversely to the direction of transportation of the web of material and pivotal movements of the bottom tool about a substantially vertical axis. The bottom tool is carried by a base with the interposition of at least one movably mounted plate. The at least one movable plate which is disposed between the base and the bottom tool is movable for adjustment of the punching tool assembly relative to the base and thus relative to the web of material. The apparatus has means adapted to be operative to reduce the friction between the base and the system which is carried thereby and which comprises the punching tool assembly and the at least one movable plate. The means for reducing the friction between the base and the movable plate are mounted on the base and/or the at least one movable plate, and are reciprocal substantially perpendicularly to the main plane of the movable plate, between an inoperative position and an operative position of being advanced towards the respective oppositely disposed at least one movable plate and/or base. In the operative position, the friction-reducing means provide for rolling friction between the base and the at least one movable plate.

In a preferred configuration the friction-reducing means are arranged on the movable plate.

In another preferred embodiment, the apparatus has first and second movable plates which are arranged in superposed relationship, similarly to a compound slide support as is known for example in the context of machine tools. One of the first and second plates is arranged movably substantially transversely to the direction of movement of the web of material while the other is arranged pivotably about a substantially vertical axis so that the two forms of movement required for adjusting the punching tool assembly relative to the web material are effected by two separate movable plates and adjustment of the punching tool assembly is constituted by the sum of the movements of the two plates. In that respect, in accordance with a further preferred feature of the invention, the arrangement can be such that the lower one of the two movable plates performs the movements transversely to the direction of movement of the web material and the upper plate performs the pivotal movements.

In accordance with another preferred feature of the invention, the friction-reducing means may also be disposed between the transversely displaceable plate and the pivotable plate, which are also displaceable between an operative and an inoperative position, in order thereby also to provide a noticeable reduction in friction for adjustment of the punching tool assembly, as between the two movably mounted plates. In that respect, it is advantageous for the means for producing rolling friction to be disposed both between the generally stationary base and the movable plate disposed thereabove, on the one hand, and also between that movable plate and the other upper movable plate disposed thereabove, with the friction-reducing means being carried in the plate between the base and the upper plate, that is to say the middle plate. In this case, the middle plate is provided with friction-reducing means which are displaceable between an operative and an inoperative position, both at the side of the middle plate which faces downwardly and thus towards the base, and also at its side which faces upwardly towards the upper plate.

In accordance with another preferred feature of the invention the friction-reducing means may be in the form of ball rolling units. That term is used to denote a device having a large rolling ball disposed within a housing which accommodates the major part of the ball in such a way that a segment or portion of the ball projects relative to the housing and the apex region of that projecting portion of the ball, in the operative position of the ball rolling unit, bears against the respectively adjacent plate. The spacing between the base and the above-mentioned middle plate on the one hand and between the middle plate and the top plate on the other hand is extremely small, when the ball rolling units are in the operative position. The spacing can be of the order of magnitude of for example 0.1 mm so that the ball rolling units only have to be displaced by a very short distance to move between the operative and the inoperative positions. In the operative position the upper plate is carried by the ball rolling units which are operatively associated therewith and which are suitably supported by the middle plate, while the middle plate is supported on the base by way of the ball rolling units which face towards the base. In the inoperative position of the ball rolling units the latter do not need to perform any support function as in that situation the plates and the base are in direct contact with each other. In that way the relatively high forces which occur in the punching operation can be transmitted to the frame structure of the machine in a simple fashion. That also prevents the ball rolling units and the members carrying them from being acted upon by the forces which occur in the punching operation.

Components like the above-described ball rolling units are known and therefore do not need to be described in greater detail herein. To provide for low-friction movement, the ball of the ball rolling unit is desirably carried in its housing with the interposition of small support balls, within a ball socket configuration. The support balls serve as carrier members for supporting the rolling ball in the housing.

Displaceability of the ball rolling unit between the operative and the inoperative positions can be effected by the housing which carries the rolling ball of the ball rolling unit being in the form of a piston which is arranged reciprocally in an opening in the respective plate, the opening serving as a cylinder for the piston. It is also possible for the ball rolling unit housing to be arranged in an additional hollow component which thus serves as a piston. At any event the position of the piston associated with the ball rolling unit depends on the cylinder being supplied for example with a pressure fluid, such as compressed air. For that purpose the plate or plates having the ball rolling units must be provided with feed conduits for a pressure fluid. For that reason, when there are friction-reducing means operatively disposed between the stationary base and the middle plate on the one hand and between the middle plate and the top plate on the other hand, it is desirable for all the ball rolling units to be associated with, that is to say carried by, the middle plate, because in that case it is easier for the feed conduits for the pressure fluid to be provided in just the one plate, namely the middle plate, in which the feed conduits are thus concentrated.

It has already been mentioned above that adjustment of the punching tool assembly and therewith the at least one movable plate must be effected with an extremely high level of accuracy, the endeavour being to provide that the two adjacent plates remain in their mutually parallel positions even when the friction-reducing means are in their operative position of holding the plates at a spacing from each other. For that purpose, in accordance with a preferred feature of the invention, provided on the plate which in the operative position of the ball rolling unit co-operates with same, and in the region of each such ball rolling unit, is a respective component in the form of a disk which is arranged adjustably in opposite relationship to the respective ball rolling unit, in a suitable recess or opening in the plate. Arranging a separate disk of that kind within the plate has in particular the advantage that the surface of the disk, that is to say the surface against which the apex region of the ball rolling unit comes to bear, can be accurately adjusted. As generally the apparatus must have at least three ball rolling units to achieve the desired effect, it is thus possible in a simple fashion to provide that all surface regions of the oppositely disposed plates, which surface regions co-operate with the ball rolling units, are disposed in the same plane. In addition the provision of separate disks affords the advantage that it is possible for them to be machined separately, and to make them from a material which is particularly suitable for co-operating with the respective ball rolling unit, for example that material being of suitable hardness and having a suitable running surface for co-operating with the ball of the ball rolling unit. Adjustability of each such disk can be achieved by the disk being provided at its side remote from the ball of the respective ball rolling unit with an opening for example in the manner of a substantially, radially extending groove, the internal surface defining same extending inclinedly in such a way that, in the region of that opening, the disk increases in thickness frcm a region of its periphery, towards the oppositely disposed region thereof. Arranged in the opening is a wedge or taper member whose surface that is towards the disk has a gradient or inclination corresponding to that of the internal surface defining the opening in the disk. The other surface of the wedge or taper member bears against the bottom of the opening in which the disk is movably disposed. In that way, radial displacement of the wedge or taper member relative to the disk can cause the position of the disk to be adjusted, perpendicularly to the main plane of the plate.

As noted above, the pistons carrying the ball rolling units can be actuated by compressed air or a hydraulic fluid.

If the transverse movement and the pivotal movement for orienting the punching tool assembly with respect to the respective portion which is to be punched out of the web material are performed by two separate plates, it is generally desirable for the plate which performs the pivotal movement to be disposed above the plate which performs the transverse movement, although the reverse arrangement is also possible. In that respect, in order to secure the position of the plate which performs the pivotal movement, that plate may be provided with a journal or trunnion portion which is desirably arranged centrally and which engages into a suitable opening in the adjacent plate. If the apparatus has first and second movable plates and if the pivotable plate is disposed above the transversely displaceable plate, the journal or trunnion member of the pivotable plate is mounted in an opening in the transversely displaceable plate. The pivotal movement can also be produced in a simple fashion by the pivotably disposed plate having a slot into which engages a projection which is displaceable for example by a piston-cylinder actuator, the slot extending inclinedly relative to the direction in which the projection is displaced.

If the apparatus has only one plate which thus performs both the transverse movement and also the pivotal movement, the plate would have to be mounted in a different manner, as is disclosed for example in EP 0 167 018 to which attention is therefore directed. In order to minimize the weight which has to be moved when aligning the punching tool assembly in relation to the respective portion of web material which is to be punched out, the invention can further provide that the upper tool of the assembly is so connected to the drive device which produces the movement required for the punching operation, that the drive device supports the upper tool, at least when the punching tool assembly is in the open condition in which the upper tool is raised away from the lower tool of the tool assembly. The connection between the drive device on the one hand and the upper tool on the other hand is such that the upper tool is displaceable relative to the drive device which is disposed vertically, in the plane in which the movements for adjustment or alignment of the punching tool assembly are effected. However, there is advantageously no play or only a very small amount of play between the drive device and the upper tool, in the direction in which the upper tool is moved for carrying out the punching operation. The consequence of the connection between the upper tool and the drive device, which connection is a positively locking engagement in the vertical direction of the upper tool, is that when the upper tool is disposed at a spacing from the lower tool, when the punching tool assembly is thus in the opened condition, the upper tool is then supported by the drive device so that its weight does not apply a loading to the plate system which carries the lower tooth. In addition that design configuration affords the advantage that the magnitude of the opening travel movement, that is to say the magnitude of the stroke movement performed by the upper tool when the punching tool assembly is opened or closed, can be selected and adjusted depending on the respective factors and parameters involved.

Further objects, features and advantages of the invention will be apparent from the following description of a preferred embodiment.

DESCRIPTION OF THE PREFERRED EMBODIMENT

Figure 1:
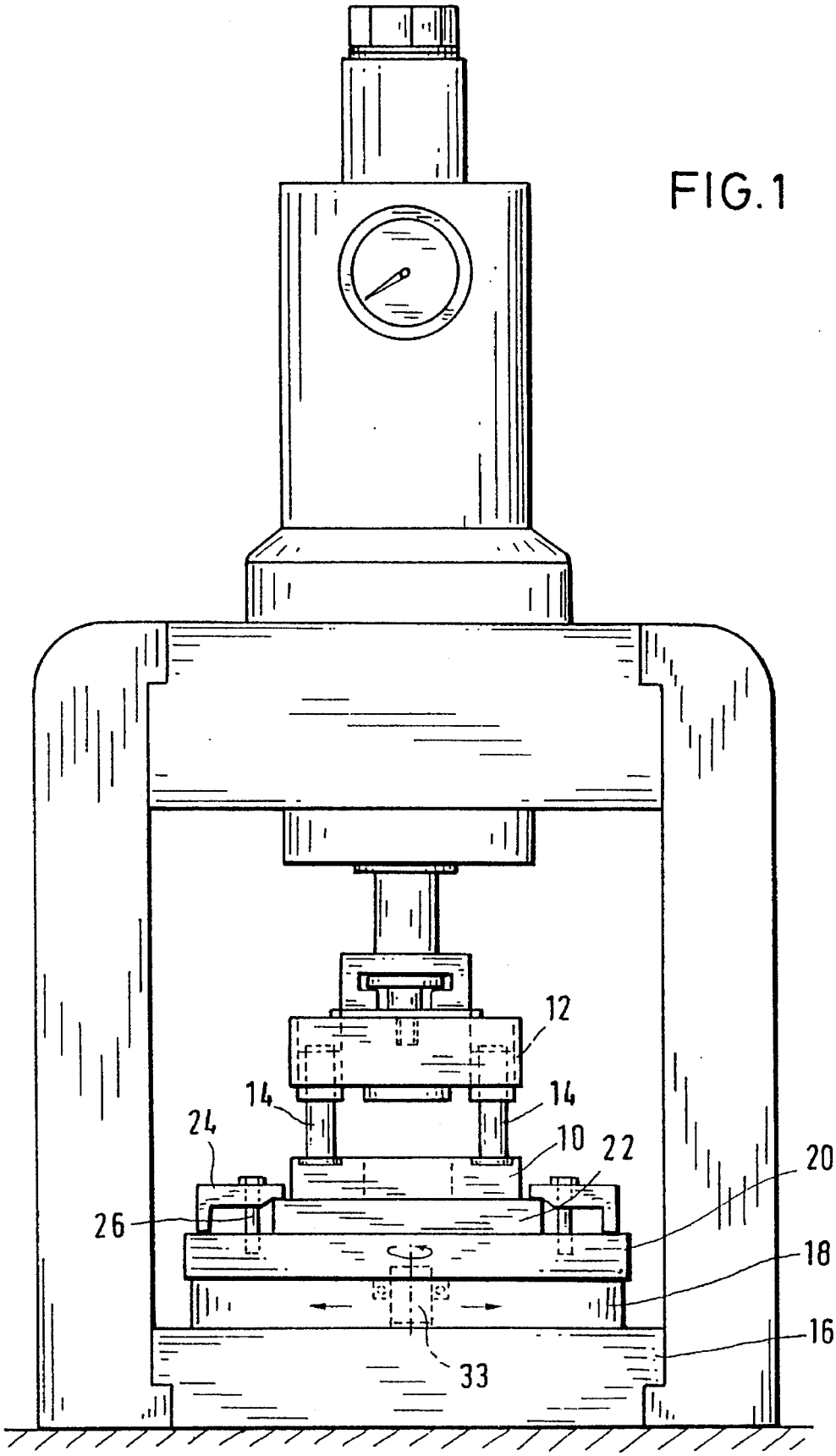
FIG. 1 is a diagrammatic side view of a punching apparatus according to the invention.

Referring generally to the drawing, the punching apparatus according to the present invention serves for severing portions from web material which for example may be provided with printing thereon, with a high degree of accuracy. The web material may be for example a plastic material on which printed circuits are successively disposed. The printed circuits are to be cut out of the web material for example with a required degree of accuracy of the order of magnitude of less than 10 μm. However the web material may also consist of other materials which are possibly provided with other forms of printing thereon, than printed circuits.

The web of material is introduced with a stepping motion into the punching apparatus. In that operation, drive motors (not shown) which are operable to produce the transportation movement of the web of material are suitably controlled to orient and align the web of material relative to the punching tool assembly of the punching apparatus, in the longitudinal direction of the web of material, that is to say in the transportation direction thereof. The web of material is for example provided with markings which, as register marks, are associated with each portion of material which is to be cut out of the web of material by means of punching. The register marks are detected by a camera and compared to the desired or reference positions of such register marks, relative to the punching tool assembly. The desired or reference positions of the register marks are suitably stored in a control arrangement. In the event of a deviation in respect of the actual position of the reference marks from the reference position, the punching tool assembly is adjusted in the manner described hereinafter so as to align it with the portion to be punched out, so that the actual position of the register marks corresponds to the reference position. The punching operation can then be appropriately carried out.

Referring now to FIG. 1, the punching apparatus has a punching tool assembly which conventionally comprises a bottom tool 10 and a top tool 12. The latter is relatively movable vertically with respect to the bottom tool 10. The top tool 12 is guided on bars or columns 14 which are carried by the bottom tool 10. The columns 14 are mounted in the four corner regions of the bottom tool 10. The general arrangement and configuration of the punching tool assembly are broadly known so that there is no need for a more detailed discussion thereof at this point.

The punching tool assembly 10, 12 is carried by a plate system having a stationary base generally indicated at 16 in FIG. 1, a first plate, or first plate means, 18 which is carried by the base 16 and which is movable transversely to the direction of movement of the web of material, the plate 18 being referred to hereinafter as the transverse plate, and a second plate means or second plate 20 which is disposed on the transverse plate 18 and which is referred to hereinafter as the rotary plate 20. The rotary plate 20 is mounted pivotably, relative to the transverse plate 18, in the plane which is parallel to the transverse plate 18. At its underside the bottom tool 10 is provided with a fixedly mounted intermediate plate 22 which in the operative position of the components is supported on the rotary plate 20 and which is clamped fast to the rotary plate 20 in the usual manner by means of clamping arms 24 which engage over the intermediate plate 22, and screws 26 which pass through the clamping arms 24.

Figure 4:
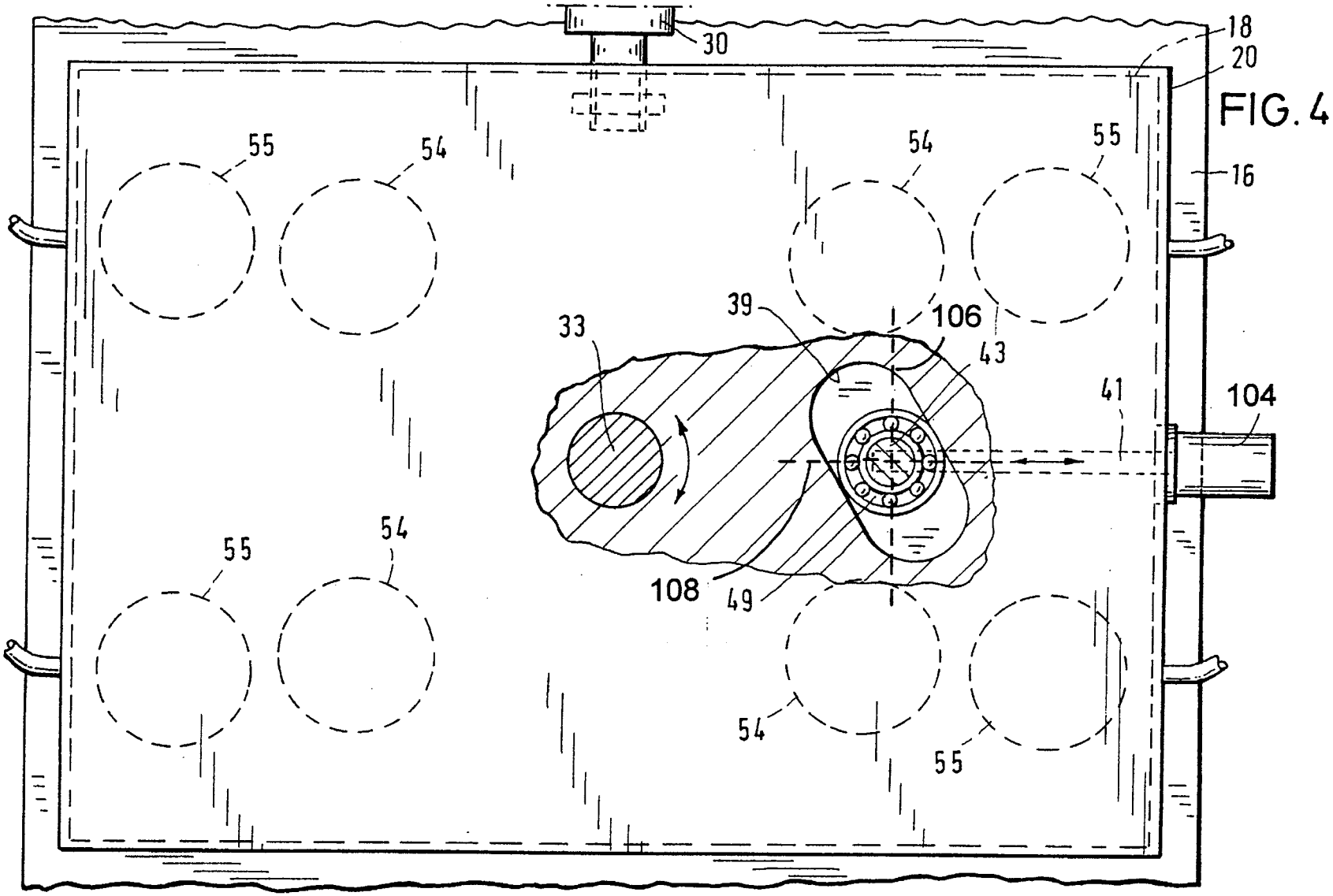
FIG. 4 is a view in the direction indicated by the line IV—IV in FIG. 2.
Figure 5:
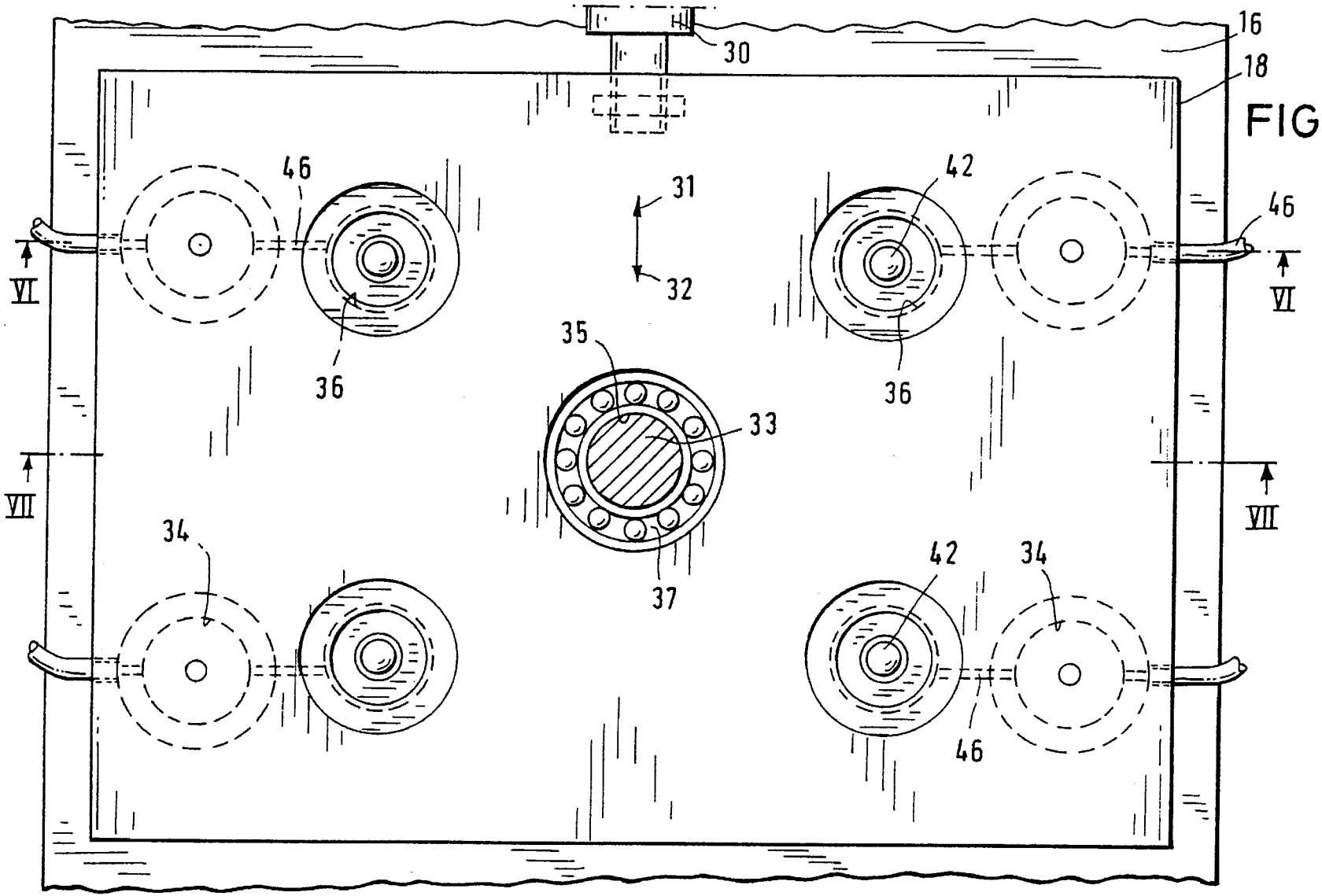
FIG. 5 is a view in the direction indicated by the line V—V in FIG. 2.
Figure 7:
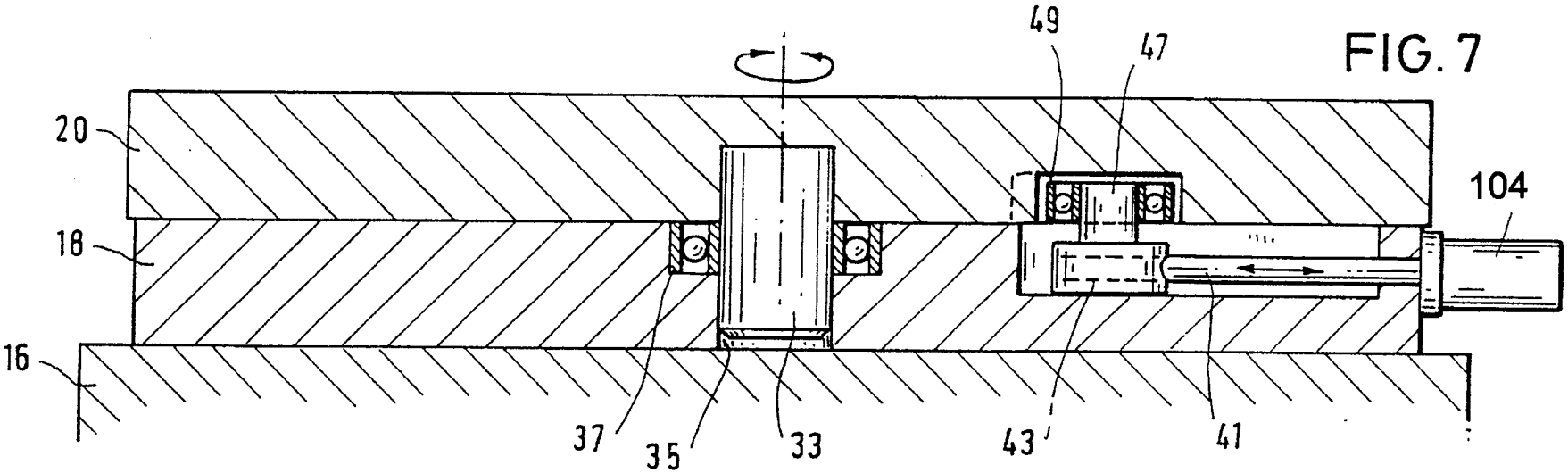
FIG. 7 is a view in the direction indicated by the line VII—VII in FIG. 5.

Looking at FIG. 5, operatively associated with the transverse plate 18 is a stepping motor 30 which is carried by the base 16 and which is operable to displace the transverse plate 18 for alignment of the punching tool assembly, in the directions indicated by the arrows 31 and 32 respectively. As shown in FIG. 4, operatively associated with the rotary plate 20 is a stepping motor 104 which is carried by the transverse plate 18. The linear movements of the transverse plate 18, produced by the stepping motor 30, do not require any particular measures to be taken for effecting such movements. The transverse plate 18 can be guided on the base 16 in a manner and by a structure which are usual for linear movements. The rotary plate 20, at its side which is towards the transverse plate 18, is provided with a rotary journal or trunnion member which is indicated at 33 in FIGS. 1, 4, 5 and 7. The trunnion member 33 engages into an opening indicated at 35 in FIGS. 5 and 7 in the transverse plate 18, the opening 35 being provided with bearings indicated at 37 in FIGS. 5 and 7 to permit rotary movement of the trunnion member 33, with the lowest possible level of friction. The rotary plate 20 is also provided with a slot as indicated at 39 in FIG. 4, which extends inclinedly relative to the two main axes, 106 and 108, of the rotary plate 20, in the view shown in FIG. 4, in the plane of the rotary plate 20. The stepping motor 104 drives a spindle 41 which at its free end, with the interposition of a screwthreaded nut 43, carries a pin or projection which is indicated at 47 in FIG. 7 and which with the interposition of a bearing 49 suitably engages into the slot 39, as can be particularly clearly seen frcm FIG. 4. Therefore a rotary movement of the screwthreaded spindle 41, produced by operation of the stepping motor 104, results in a corresponding displacement of the projection 47 transversely to the directions indicated by the arrows 31 and 32 in FIG. 5, so that, by virtue of the co-operation of the projection 47 and the slot 39, displacement of the projection 47 results in a pivotal movement of the rotary plate 20 about the pivot axis defined by the trunnion member 33.

In order to be able easily to effect accurate adjustment of the two plates 18 and 20 for the purposes of suitable alignment and orientation of the punching tool assembly, it is necessary, for the adjustment procedure, for the transverse plate 18 to be moved into a respective appropriate position relative to the base 16 and for the rotary plate 20 to be moved into a respective appropriate position relative to the transverse plate 18, and for the base and the plates to be supported relative to each other in such a way that the movements of the transverse plate 18 and the rotary plate 20 are possible without high frictional forces having to be overcome for that purpose. To achieve that, the transverse plate 18 is provided with special means which on the one hand make it possible for the transverse plate 18 to be slightly lifted relative to the base 16 and for the rotary plate 20 to be slightly lifted relative to the transverse plate 18, and which on the other hand permit the plates to be supported relative to each other by first friction reducing means which permits low-friction movement of the transverse plate 18 relative to the base 16 and a second friction reducing means which permits low-friction movement of the rotary plate 20 relative to the transverse plate 18. For that purpose, as can be seen from FIGS. 5 and 6, the transverse plate 18 is provided with a total of 8 bores 34, 36, of which four bores 34 are open downwardly in a direction towards the base 16 and the other four bores 36 are open upwardly towards the rotary plate 20. The two groups of bores 34 and 36 respectively are arranged in such a way that the bores of each group define the corners of a rectangle which in each case is smaller than the substantially also rectangular transverse plate 18. Arranged in each of the bores 34, 36 is a respective piston 38 which is of a cup-like configuration, as can be seen for example from FIG. 8, the open end of the cup-like configuration of the piston 38 being associated with the opening of the respective bore in the plate, the position of which is influenced by the respective piston 38 in a manner to be described hereinafter. As can be seen from FIGS. 8 and 9, each cup-shaped piston 38 serves to accommodate a respective housing 40 in which a rolling ball 42 is arranged. The rolling ball 42 is mounted within the housing 40 with the interposition of a plurality of small support balls (not shown). Each housing 40 with rolling ball 42 rotatably accommodated therein forms a device referred to herein as a ball rolling unit. The downwardly open bores 34 act as cylinders, which, together with their associated pistons and ball rolling units, serve as the first friction reducing means. Similarly, the upwardly open bores 36 act as cylinders, which, together with their associated pistons and ball rolling units, serve as the second friction reducing means. The arrangement in that respect is such that the housing 40 which is also of a generally cup-like configuration and which is open at the side at which the respectively associated bore 34 or 36 is also open is provided with a ring 44 having an opening for the respective rolling ball 42, through which a segment portion of the rolling ball projects outwardly from the housing 40. The opening in the ring 44 is smaller than the largest diameter of the rolling ball 42 so that the latter is held in its position within the housing 40 by the ring 44. The configuration and arrangement of rolling ball units of this kind are known and therefore do not need to be described in any greater detail herein.

Figure 8:
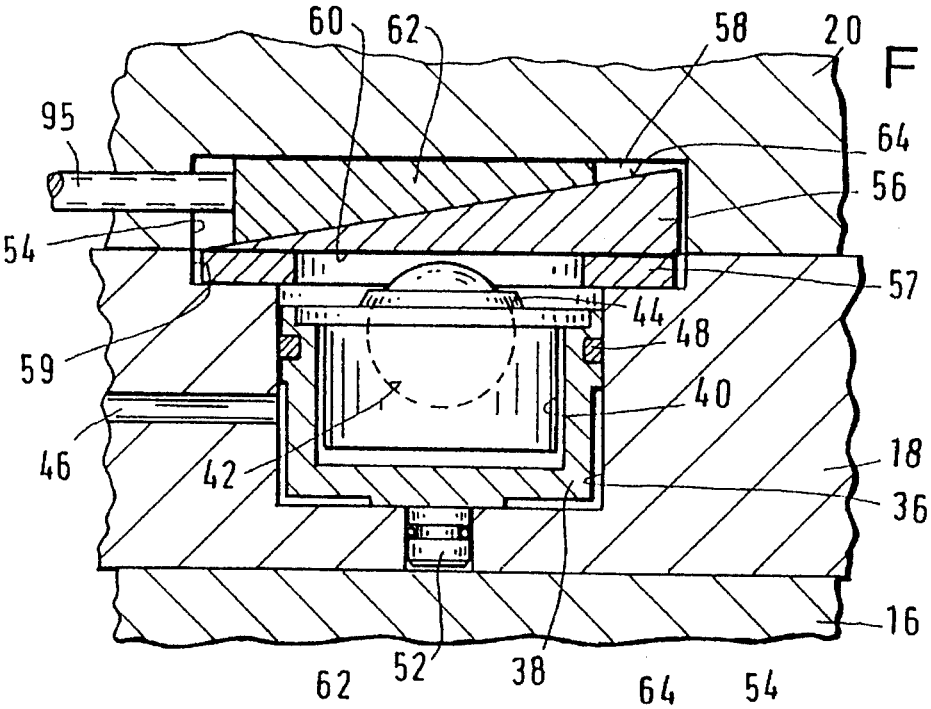
FIG. 8 shows a detail from FIG. 6 on a larger scale.
Figure 9:
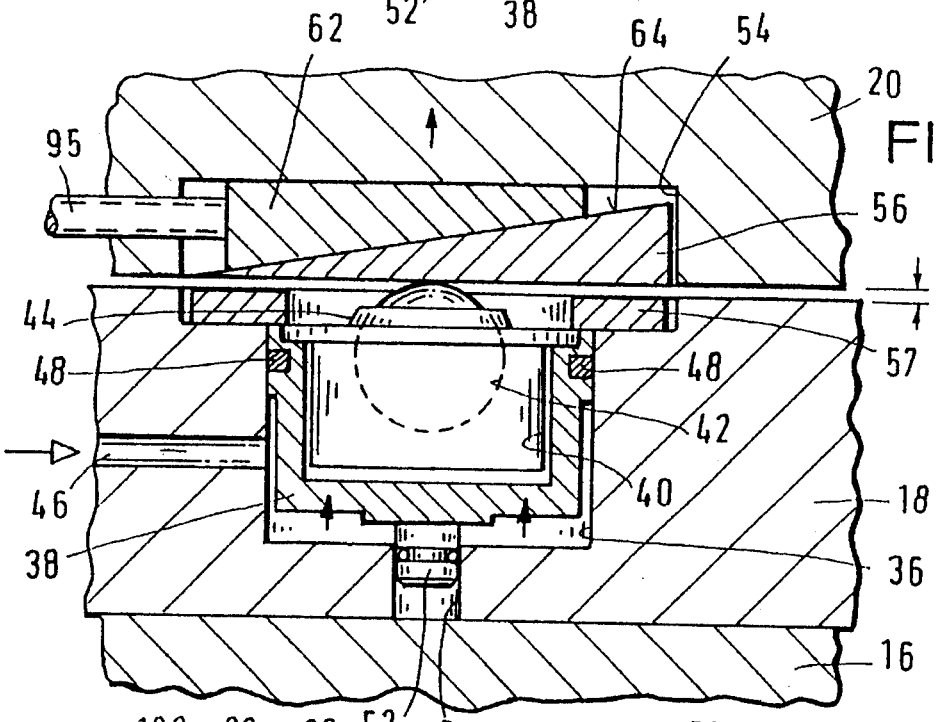
FIG. 9 is a view corresponding to FIG. 8 but in which the members are in a different position.

Associated with each bore 34 and 36 is a respective ring as indicated at 57 in FIGS. 8 and 9 for example, which is disposed in a suitable enlarged portion 59 of the respective bore 34, 36 and serves as a limiting means for limiting the stroke movement of the respective piston 38.

Each of the bores 34 and 36 can be connected to a compressed air source (not shown) by way of a conduit system which is indicated at 46 in FIGS. 8 and 9 and which is disposed in the transverse plate 18. When the bores 34 and 36 which act as cylinders for the respective pistons 38 are subjected to the effect of compressed air from the compressed air source, the piston 38 which is provided with a sealing ring 48 (see FIGS. 8 and 9) is displaced towards the respective plate 16 or 20 which is disposed in opposite relationship to the open end of the respective bore 34 or 36. At the end remote from the rolling ball 42, each of the bores 34 and 36 continues into a bore 50 of substantially smaller diameter. An extension portion 52 of the respective piston 38 is slidably guided in the bore 50.

Figure 6:
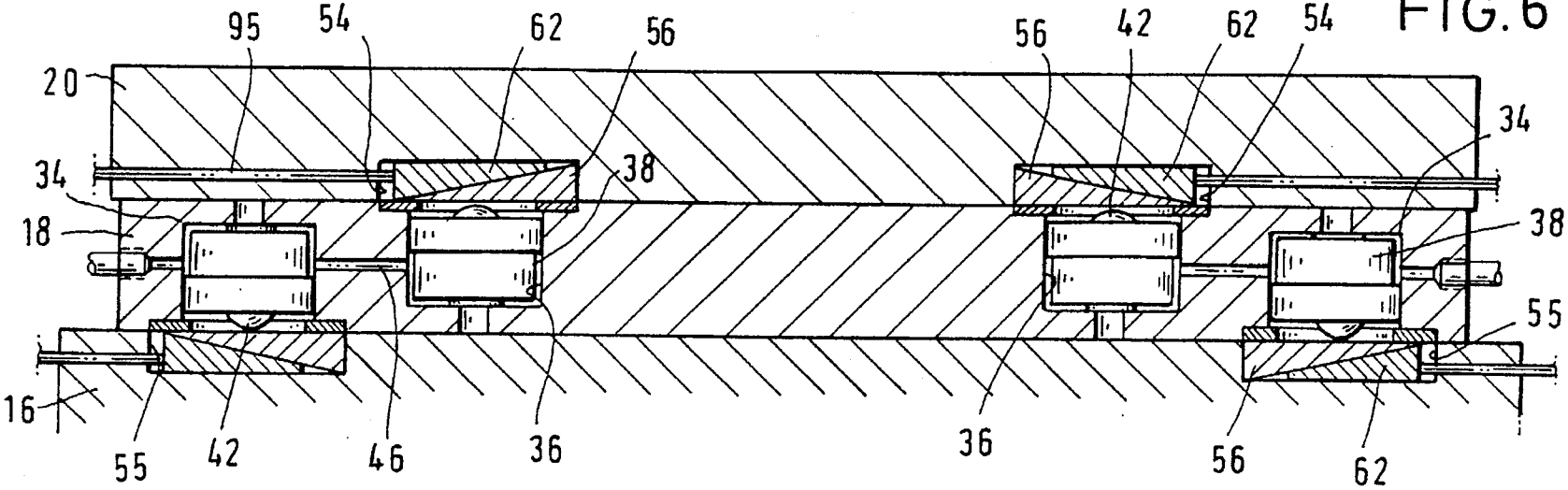
FIG. 6 is a view in the direction indicated by the line VI—VI in FIG. 5.

Looking now also at FIGS. 4 and 6, as well as FIGS. 8 and 9, the base 16 and the plate 20 which are each immediately adjacent to the transverse plate 18 at respective sides thereof are each provided with a respective opening or recess 54 and 55 respectively, in the regions which are respectively disposed in opposite relationship to the bores 34 and 36. Disposed in each of the openings 54 and 55 is a circular disk 56. The end face 60 of each disk, which is disposed in opposite relationship therefore to the respective rolling ball 42, is flat. On the rear side of the disk 56, which is thus towards the bottom of the respective opening 54 or 55, the disk 56 is provided with a recess or opening 58 in the form of a groove extending substantially radially. The boundary surface 64 of the recess 58 which is towards the flat end face 60 of the disk 56 and which is therefore the inner boundary surface of the recess 58 extends inclinedly from a peripheral region of the disk 56 to the diametrally oppositely disposed peripheral region, in such a way that it forms a wedge or taper surface. A wedge or taper member 62 can be substantially radially inserted into the recess 58, with the boundary surface of the wedge or taper member 62, which is towards the disk 56, being at the same angle as the surface 64 of the recess 58 in the disk 56. The recesses 54 are provided at the underside of the rotary plate 20 and the recesses 55 are provided at the top side of the base 16, as can be clearly seen from FIG. 7. The wedge or taper member 62 is adjustable by way of a spindle indicated at 95 in FIGS. 8 and 9, which for example can be actuated manually.

Figure 11:
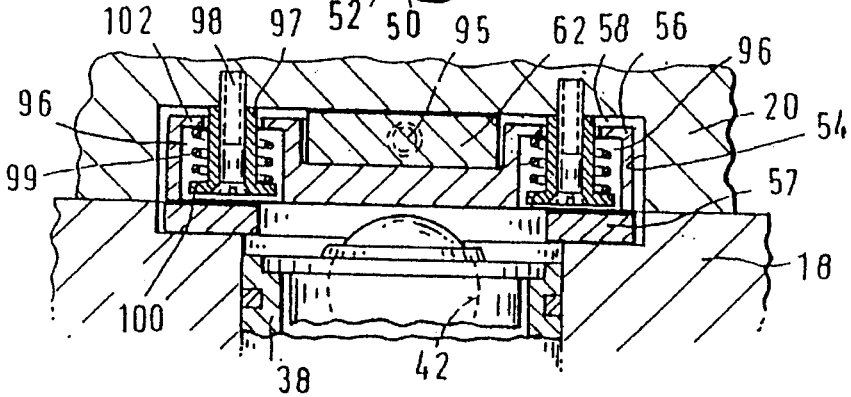
FIG. 11 is a view which is turned through 90° relative to the views in FIGS. 8 and 9, with the components in the position shown in FIG. 8.

Looking now at FIG. 11, the disks 56 are each provided with at least two axial openings 96 therethrough, which each serve to accommodate a respective bush 97 which is held in its position by a screw 98 extending through the bush 97. The screw 98 is screwed into a screwthreaded hole in the respective plate, being the rotary plate 20 in the structure shown in FIG. 11. The arrangement here includes a compression spring 99 which is disposed around the respective bush 97 and of which one end bears against the head portion 100 of the bush 97 while the other end bears against a collar 102 on the disk 56. The collar 102 forms a restriction in respect of the opening 96, at the side of the disk 56 which is remote from the respective rolling ball 42. The above-described structural configuration provides that the disk 56 is urged towards the wedge or taper member 62 by the compression springs 99.

The above-described configuration of the punching apparatus and in particular the use of two plates which are adjustable separately frcm each other affords the possibility that, after the position of the at least one register mark which is associated with the portion of web material that is to be punched out, has been ascertained relative to the position of the punching tool assembly, and after the control values have been ascertained for the required adjustment of the punching tool assembly relative to the respective portion to be punched out, the two plates 18 and 20 can be moved in such a fashion that as a result the punching tool assembly can be moved along a resulting vector into the desired or reference position thereof in which it is properly aligned with the portion of web material to be punched out. There is therefore no need for the movements of the two plates 18 and 20 to be effected in such a way that the punching tool assembly has to move on the co-ordinates which define the deviation between the actual value and the reference value, in the motion performed by the punching tool assembly.

Figure 2:
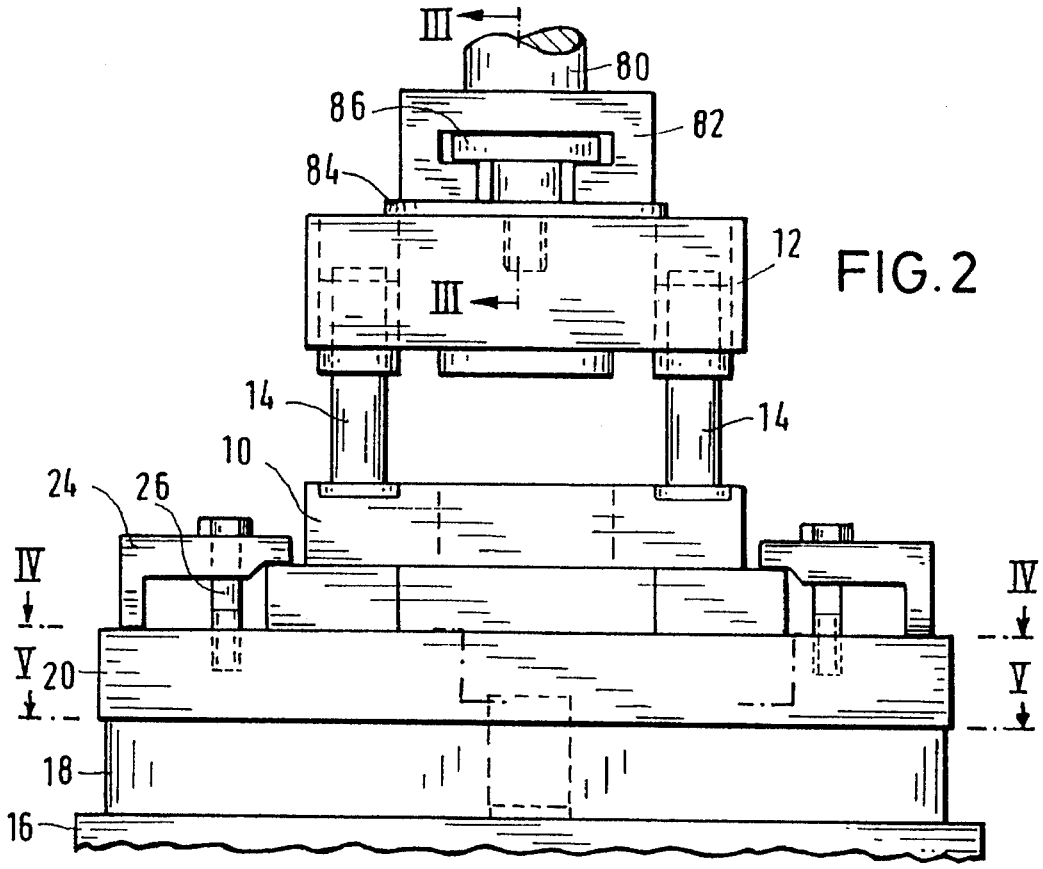
FIG. 2 shows a part of the structure shown in FIG. 1 on an enlarged scale.
Figure 3:
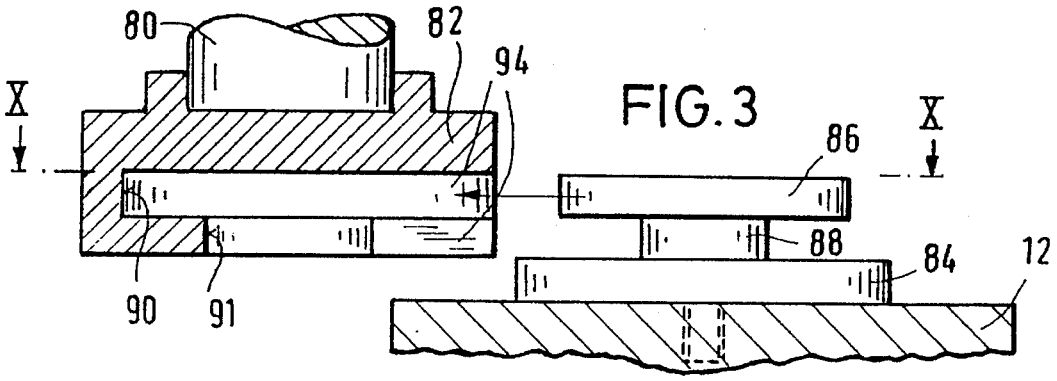
FIG. 3 is a view looking in the direction indicated by arrows III—III in FIG. 2, but with the two co-operating members occupying their positions before they are fitted together.
Figure 10:
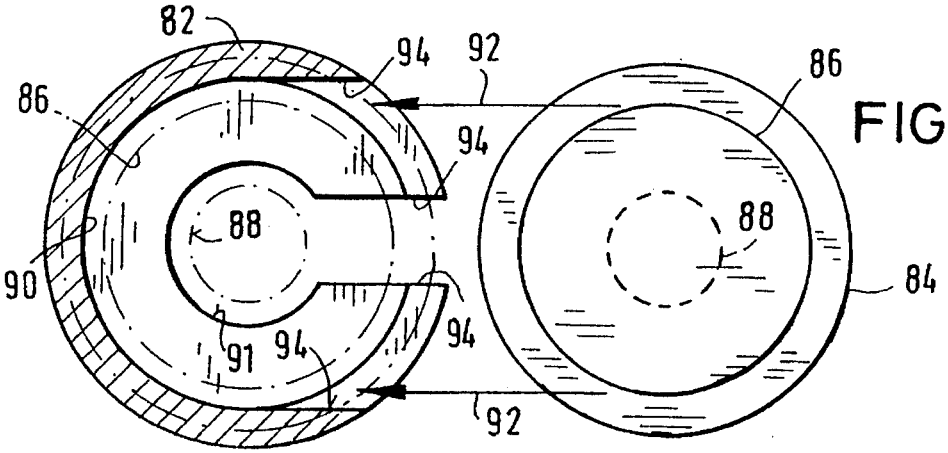
FIG. 10 is a plan view corresponding to FIG. 3.

Looking now at FIGS. 2 and 3, operatively associated with the top tool 12 is a drive means in the form of a piston-cylinder actuator having a piston rod 80 provided at its free end with a coupling member 82 which co-operates with a coupling member 84 provided on the top tool 12, to produce a connection between the piston rod 80 and the top tool 12 of the punching tool assembly. The coupling member 84 has a substantially horizontal disk portion 86 carried by a portion 88 of considerably smaller diameter. The coupling member 82 which is mounted on the piston rod 80 has a substantially circular opening 90 whose diameter is larger than the diameter of the disk 86 but whose extent in the axial direction is matched to that of the disk 86 in such a way that the disk 86 can be introduced with minimum possible clearance into the opening 90 from the side, that is to say in the direction indicated by the arrows 92 in FIG. 10. For that purpose the coupling member 82 is laterally provided with an aperture 94 forming a passage through which the coupling member 84 on the top tool 12 can be inserted into the coupling member 82 in the direction indicated by the arrows 92. Because the diameters of the openings 90 and 91 in the coupling member 82, for receiving the portions 86 and 88 respectively of the coupling member 84, transversely to the longitudinal axis of the piston rod 80, are of a somewhat larger diameter than the disk 86 and the portion 88 respectively, a relative transverse movement between the two coupling members 82 and 84 and thus also between the drive means having the piston rod 80 and the top tool 12 and therewith the entire punching tool assembly is possible, without however involving noticeable displaceability between the two coupling members 82, 84 in the direction of the longitudinal axis of the piston rod 80. The extent of that relative horizontal mobility depends on the distances by which the punching tool assembly has to be moved for the purposes of adjustment thereof relative to the portion which is to be punched out of the web of material. As the extent of the movements required for adjustment of the punching tool assembly is generally very slight, it is also sufficient to involve correspondingly small tolerances between the two coupling members, which tolerances can be of the order of magnitude of a few millimeters.

At any event the above-described arrangement provides that the weight of the top tool 12 is carried by the piston rod 80 and thus by the drive means, so that, when adjusting the punching tool assembly relative to the portion to be cut out of the web of material by operation of the punching tool assembly, it is only the weight of the lower tool with the associated components, for example the columns 14, that acts on the above-described system comprising the base 16 and the plates 18 and 20. This means that, when adjusting the punching tool assembly, the means described above for reducing friction between the base 16 and the plate 18 and between the plate 18 and the plate 20 only have to take account of the weight of the bottom tool with operatively associated components.

It will be appreciated that various modifications and alterations may be made in the above-described apparatus which has been set forth only by way of illustration and example of the principles of the present invention. For example, as a departure from the structure shown in the drawing, it is possible to provide for example only three co-operating ball rolling units, or more than four co-operating ball rolling units.

What is claimed is:

1. A punching apparatus including:

a punching tool assembly comprising a bottom tool, a top tool and means for relatively moving the top tool with respect to the bottom tool for punching a web of material;

a base having a surface;

at least one plate having a surface which is disposed on said surface of the base, the bottom tool being disposed on the at least one plate;

means for displacing the bottom tool relative to the base for adjustment of the punching tool assembly relative to the base and thereby to the web of material;

means connecting the top tool to the bottom tool for displacement therewith; and first friction-reducing means for reducing friction between said surfaces of the base and the at least one plate carried thereby, the first friction-reducing means being operatively disposable between said base and said at least one plate and being reciprocable between an inoperative position in which said first friction reducing means disengages from said surfaces and an operative position in which said first friction-reducing means engages one of said surfaces providing rolling friction between the base and the at least one plate;

wherein said at least one plate comprises a first plate and a second plate, the first plate and the second plate being arranged in superposed relationship, one of said plates being movable substantially transversely to the direction of movement of the web of material and the other being arranged pivotally about a substantially vertical axis whereby the first and second plates are displaceable for producing adjustment of the punching tool assembly relative to the web of material and adjustment of the punching tool assembly arises out of the sum of the movements of the two plates, and further including a second friction-reducing means operatively disposed between said first and second plates and displaceable between an operative and an inoperative position.

2. Apparatus as set forth in claim 1 wherein the first plate is located below the second plate and is displaceable transversely to the direction of movement of the web of material and the second plate is adapted to perform the pivotal movement.

3. Apparatus as set forth in claim 1 wherein the first friction-reducing means comprises a plurality of ball rolling units and a plurality of piston-cylinder means adapted to displace said ball rolling units between said inoperative and operative positions, each said piston-cylinder means including a piston reciprocal within an opening serving as a cylinder in said first plate whereby in the operative position in which the ball rolling units perform a support function the ball rolling units provide a small spacing between said base and said first plate; and wherein said second friction-reducing means comprises a plurality of ball rolling units and a plurality of piston-cylinder means adapted to displace said ball rolling units between said inoperative and operative positions, each said piston-cylinder means including a piston reciprocal within an opening serving as a cylinder in said first plate whereby in the operative position in which the ball rolling units perform a support function the ball rolling units provide a small spacing between said first plate and second plate.

4. Apparatus as set forth in claim 3 wherein each said piston-cylinder means is associated with one of said ball rolling units.

5. Apparatus as set forth in claim 1 wherein the base and the first plate lie in direct contact with each other when the first friction-reducing means is placed in the inoperative position, and wherein the first and second plates lie in direct contact when the second friction-reducing means is placed in the inoperative position.

6. Apparatus as set forth in claim 1 wherein said first plate is movable substantially transversely to the direction of movement of the web of material, said second plate is arranged pivotally about a substantially vertical axis, and said first plate is located below said second plate.

7. Apparatus as set forth in claim 6 including a stepping motor for adjustment of the second plate, carried by the first plate.

8. A punching apparatus including:

a punching tool assembly comprising a bottom tool, a top tool and means for relatively moving the top tool with respect to the bottom tool for punching a web of material;

a base having a surface;

at least one plate having a surface which is disposed on said surface of the base, the bottom tool being disposed on the at least one plate;

means for displacing the bottom tool relative to the base for adjustment of the punching tool assembly relative to the base and thereby to the web of material;

means connecting the top tool to the bottom tool for displacement therewith; and first friction-reducing means for reducing friction between said surfaces of the base and the at least one plate carried thereby, the first friction-reducing means being operatively disposable between said base and said at least one plate and being reciprocable between an inoperative position in which said first friction reducing means disengages from said surfaces and an operative position in which said first friction-reducing means engages one of said surfaces providing rolling friction between the base and the at least one plate;

wherein the first friction-reducing means comprises a plurality of ball rolling units and a plurality of piston-cylinder means adapted to displace said ball rolling units between said inoperative and operative positions, each said piston-cylinder means including a piston reciprocal within an opening serving as a cylinder in said at least one plate whereby in the operative position in which the ball rolling units perform a support function the ball rolling units provide a small spacing between said base and said at least one plate.

9. Apparatus as set forth in claim 8 wherein each said piston-cylinder means is associated with one of said ball rolling units.

10. Apparatus as set forth in claim 8 wherein said base has a plurality of regions against which the ball rolling units bear at least in their operative position, said regions are in the form of portions disposed in openings in the base and displaceable transversely to said surface of said base.

11. Apparatus as set forth in claim 10 wherein said portions are disks arranged in said openings in the base.

12. Apparatus as set forth in claim 11 wherein said disks have a side remote from the ball rolling units with a tapered surface, and further including a wedge means arranged longitudinally displaceably in the opening in the base and co-operable with said tapered surface for adjustment of the position of the disk in the opening.

13. Apparatus as set forth in claim 12 wherein said side of said disks remote from the ball rolling units are each provided with a groove of varying depth which in its deepest part is of a tapered configuration and wherein the wedge means is arranged in the groove.

14. Apparatus as set forth in claim 12 wherein each said disk is provided with at least first and second axial holes, and further including screws through said holes for holding the disk in the opening in the base, and spring means interposed between said disk and said base.

15. A punching apparatus for a web of material having a direction of transportation through the punching apparatus comprising:

a base;

a first plate means carried on the base;

a second plate means carried on the first plate means;

a punching tool assembly including a bottom tool supported by the second plate means, a top tool co-operable with the bottom tool for punching the web, means for moving the top tool with respect to the bottom tool for the web-punching operation, and connecting means connecting the bottom tool and the top tool together for joint movement thereof relative to the web for adjustment of the punching tool assembly relative to the web;

first actuating means operatively connected to one of said plate means for adjustment thereof transversely to the direction of transportation of the web through the apparatus;

second actuating means operatively connected to the other plate means for pivotal movement thereof about a substantially vertical axis for adjustment relative to said web about said axis; and means for reducing friction between said base and said first and second plate means during adjustment of said punching tool assembly, said friction reducing means being carried by said first plate means and including friction-reducing portions reciprocable substantially perpendicularly to the base and said second plate means between an inoperative position in which said first plate means is at least substantially in contact with said second plate means and with said base and an operative position in which said friction-reducing portions are in respective positions of lifting said first plate means from said base and said second plate means from said first plate means, the friction-reducing portions providing rolling friction between said base and said first plate means and between said first plate means and said base.

* * * * *